US005758252A

United States Patent [19]

Enomoto et al.

[11] Patent Number: 5,758,252

[45] Date of Patent: May 26, 1998

[54] IMAGE FORMING APPARATUS WITH IMPROVED TRANSPORTATION OF CURLED SHEETS

[75] Inventors: Yoshihiro Enomoto; Nobuo Hyakutake; Fumio Furusawa; Masaaki Tokunaga; Keiji Yamamoto; Tetsuya Fujita; Kazuhiko Miyazato, all of Ebina, Japan

[73] Assignee: Fuji Xerox Co., Ltd., Tokyo, Japan

[21] Appl. No.: 710,143

[22] Filed: Sep. 13, 1996

[30] Foreign Application Priority Data

Sep. 20, 1995 [JP] Japan ..... 7-242141

[51] Int. Cl.[6] ..... G03G 21/00

[52] U.S. Cl. ..... 399/407; 271/307; 399/398; 399/406

[58] Field of Search ..... 399/398, 399, 399/406, 407, 381; 271/900, 307, 311, 312, 313

[56] References Cited

U.S. PATENT DOCUMENTS 4,751,547 6/1988 Fratangelo .
5,086,318 2/1992 Takeda et al. .
5,537,193 7/1996 Hasegawa .
5,543,908 8/1996 Suzuki .

*Primary Examiner*—R. L. Moses
*Attorney, Agent, or Firm*—Oliff & Berridge, PLC

[57] ABSTRACT

An image forming apparatus includes an image carrying body on which a toner image is created. A sheet carrying/transporting rotational body adsorbs a recording sheet to which the toner image on the image carrying body is transferred, and transports the sheet. The recording sheet is detached after transfer from the sheet carrying/transporting rotating body, and an assisting device thrusts against the non-image area of the recording sheet to limit its detachment from the sheet carrying/transporting rotating body. The image forming device can prevent transportation failure and image smudging that is otherwise generated when a thick sheet provided with a curl before it is adsorbed to a sheet carrying/transporting rotational body is detached in the curved state from the rotational body and transported to a fusing means.

6 Claims, 7 Drawing Sheets

IMAGE FORMING APPARATUS WITH IMPROVED TRANSPORTATION OF CURLED SHEETS

BACKGROUND OF THE INVENTION

The present invention relates to an image forming apparatus such as a copier, printer, etc. of the type in which after a recording sheet is electrostatically adsorbed on a sheet carrying/transporting rotational body, a toner image on an image carrier is electrostatically transferred on the recording sheet, and more particularly to an image forming device which can use a relatively thick sheet as a recording sheet.

Conventionally, a color image forming apparatus using a drum-shaped sheet carrying/transporting rotary body (hereinafter also referred to "transfer drum") could electrically adsorb a recording sheet on the transfer drum and carry it with no trouble as long as the sheet has a weighing capacity of up to about 104 g/m$^2$. However, even if a charging means is used, it was difficult to adsorb a relatively thick sheet having a weighing capacity exceeding 104 g/m$^2$ (hereinafter referred to as "thick sheet") in intimate contact, on the circumferential surface (or carrying surface), because of firmness of such thick sheet.

For this reason, the above type of color image forming apparatus previously gives a curl to a thick sheet before it is adsorbed on the transfer drum so that it accords to the curvature of the carrying surface of the transfer drum. The thick sheet with the curl is supplied to the transfer drum and electrostatically adsorbed thereon.

However, the image forming apparatus in which the curl is given to the thick sheet before it is adsorbed on the transfer drum has the following problems.

As shown in FIG. 7, a thick sheet which is curled and thereafter electrostatically adsorbed on a transfer drum 100, when it is separated form the transfer drum 100 after completion of transfer, the major part thereof is detached in its curved state (profile) (see the sheet in solid line). Therefore, the position where the thick sheet 101 is detached from the transfer drum 100 shifts, in a detachment process, from a separation position by a separation piece 102 toward a transfer position where the sheet is opposite to an image carrying body 103. As a result, the area where the thick sheet 101 is adsorbed on the transfer drum 100 when the former is separated from the latter is reduced. This makes it impossible to hold the state where the sheet is transported to a fusing means 104 while it is urged by the rotary force of the transfer drum 100, thus providing transportation failure as the case may be.

Since the thick sheet 101 is detached in a curved state, as shown in FIG. 7, in detachment, while being in contact with the a detachment/discharging device 105 for discharging charges on the surface of the thick sheet 101 and a fusing device 104 and its peripheral component (e.g. cover 104*a* of the fusing device), it will be transported to a transfer section of the fusing device (the sheet indicated by two-dot chain line in the figure). This will produce an "image smudging phenomenon" (smudge) that an unfixed toner image on the thick sheet 101 is smudged. In FIG. 7, reference numeral 106 denotes an adsorption/transfer charging means.

In order to obviate such difficulty, it is proposed to attach the detachment/discharging device 102 at a position more apart than before from the detachment position so that the thick sheet detached in its curved state is not in contact with the detachment/discharging device. In this case, however, the inherent discharging capacity of the detachment discharging device will be lowered so that toners will be scattered in detachment, thus leading disorder in the image.

Unexamined Publication JP-A-3-152579 discloses a technique in which a casing end 21$b_1$ of a charging corotron 21 on the side of a detachment piece 22 is formed at a position apart from the transfer drum 108. In this case, the curved sheet is likely to be brought into contact with the opposite casing end of the discharging corotron on the side of the image carrier 4. Thus, this technique is not a satisfactory solving means.

On the other hand, as shown in FIG. 8, the thick sheet 101 detached in the curved state, while being guided by a sheet transporting guide member 107, will be led to nip sections of a pair of fusing rolls (e.g. heating roll and pressurizing roll) 108*a* and 108*b* of the fusing means 104. Before the sheet 101 is led to the nip section, the proximity of the tip of the thick sheet 101 is brought into contact with the cover 104*a* of the fusing device 104*a*, thus producing an image smudging phenomenon. In addition, in this case, even if the end of the cover 104*a* of the fusing device is displaced upwards, the tip of the thick sheet will be brought into contact with the upper fusing roll 108*a*, thus smudging the image.

SUMMARY OF THE INVENTION

An object of the present invention is to provide an image forming device which can prevent transportation failure and an image smudging phenomenon which is generated when a thick sheet provided with a curl before it is adsorbed to a sheet carrying/transporting rotational body is detached in the curved state from the rotational body and transported to a fusing means, thus performing satisfactory sheet transportation.

Another object of the present invention is to provide an image forming apparatus which can prevent an image smudge phenomenon due to contact with a fusing means when a thick sheet is detached in its curved state from a sheet carrying/transporting rotational body and transported to the fusing means.

In order to attain the above object, the image forming apparatus according to the present invention comprises: an image carrying body on which a toner image is created; a sheet carrying/transporting rotational body for adsorbing a recording sheet to which the toner image on the image carrying body is transferred and transporting the sheet; a detaching means for detaching the recording sheet after transfer from the sheet carrying/transporting rotating body; and a recording sheet transporting assisting device which thrusts the non-image area of the recording sheet to suppress the detachment of the recording sheet.

Further, in the image forming apparatus according to the present invention, the recording sheet transportation assisting device pushes the detached recording sheet towards said detachment means.

The image forming apparatus according to the present invention further comprises a curl imparting means for imparting to a thick recording sheet a curl in a direction along the carrying curve of the rotational body before the thick recording sheet is adsorbed to said sheet carrying/transporting rotational body, wherein said recording sheet transportation assisting device pushes the recording sheet in a direction opposite to said curl imparting direction.

A thick sheet refers to a firm sheet which requires imparting of a curl in order to assure its good electrostatic adsorption on the sheet carrying/transporting rotational body. For example, the thick sheet has a weighing capacity larger than 104 g/m$^2$.

The application of the present invention is not limited to the case where a curl is imparted to said thick recording sheet. For example, the present invention can be applied to the case of a firm recording sheet such as OHP sheet, or the case where a normal recording sheet has become firm in a high humidity environment so that the recording sheet floats from the sheet carrying/transporting rotational body simultaneously with start of the detachment.

The non-image area of a recording sheet thrust by a thrusting member refers to the non-image area portion in parallel to a sheet transporting direction.

In the present invention having the above technical means, where a fusing means including a pair of fusing rolls rotating in contact with each other is used, the tip of said recording sheet after detachment is initially brought into contact with the lower fusing roll in front of a nip portion of said fusing rolls.

In the present invention, the distance between the tip of said detachment means and the fusing portion of the fusing means is preferably shorter than the length of the recording sheet having a smallest size in the sheet transporting direction.

The image forming apparatus having the above technical means, where a fusing means including a pair of fusing rolls rotating in contact with each other, a sheet transporting guide member for guiding the recording sheet after detachment while supporting it from the lower side thereof is arranged so that the tip of said recording sheet is initially brought into contact with the lower fusing roll in front of a nip portion of said fusing rolls.

The image forming apparatus having the above technical means according to the present invention comprises, as a recording sheet transportation assisting device, a plurality of thrusting members thrusting thick recording sheets having different sizes in a direction perpendicular to a sheet transporting direction, respectively and said thrusting member of said plurality of thrusting members thrusting the recording sheet having a smaller size is provided shiftably in the direction of thrusting. The plurality of thrusting members are caused to thrust the recording sheets having different sizes in the direction perpendicular to the sheet transporting direction in accordance with the different sizes, and at least the thick recording sheet having a smaller size is preferably thrust by the shiftable thrusting member which is shiftable only when the thick sheet at issue is to be transported.

In this case, the thrusting by the shiftable thrusting means is preferably carried out in engagement with a detachment operation of the said detachment means for detaching the thick recording sheet from the sheet carrying/transporting rotational body.

At least one of fixed thrusting members not provided shiftably in the recording sheet transportation assisting device is located on a reference terminal side of a sheet transportation path, and the thick recording sheet detached and transported along the reference terminal of the sheet transportation path is preferably thrust by the thrusting member fixedly on the side of the reference edge.

DETAILED DESCRIPTION OF PREFERRED EMBODIMENTS

Figure 1:
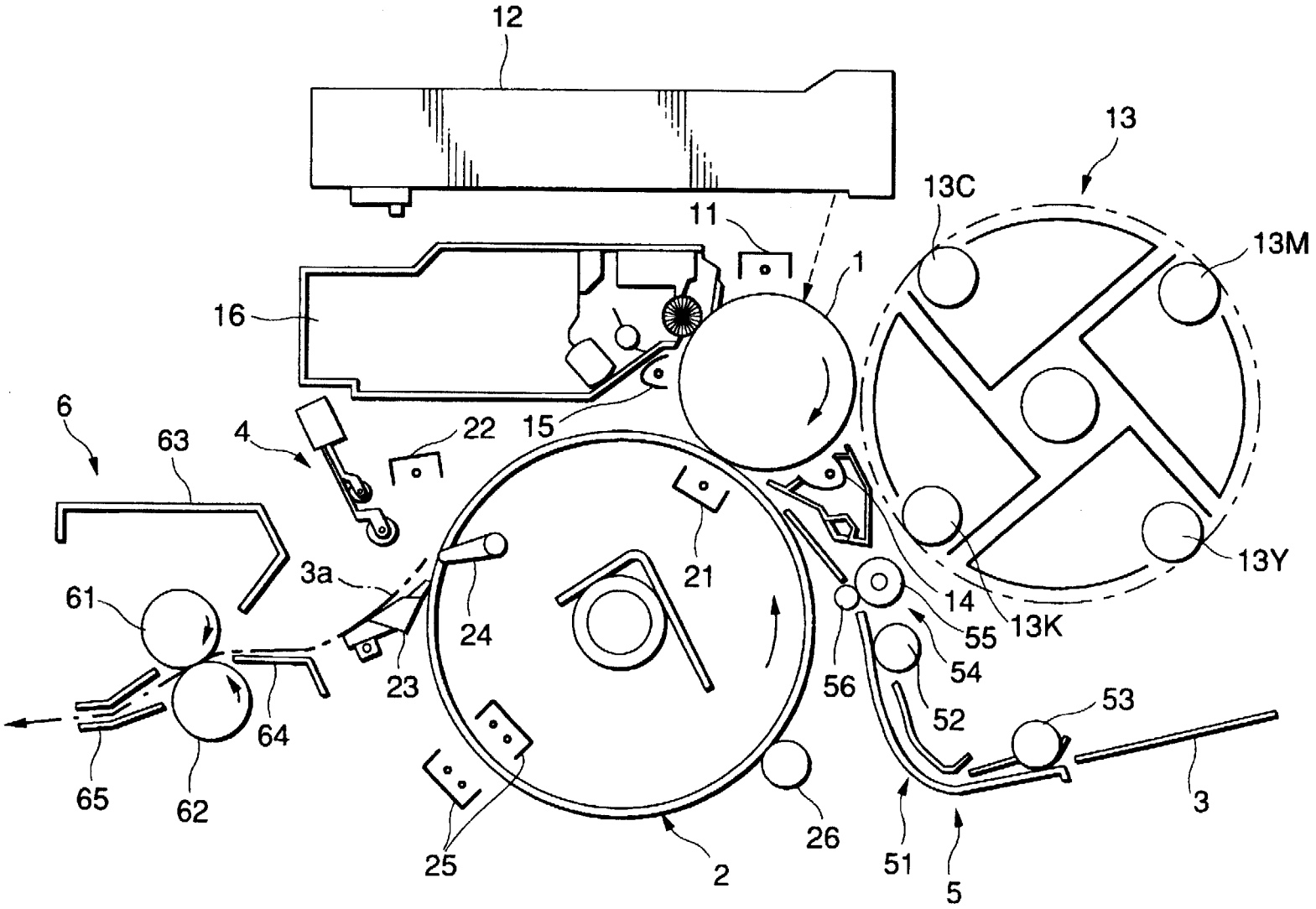
FIG. 1 is a schematic conceptual view of an embodiment of the image creation device according to the present invention.
Figure 2:
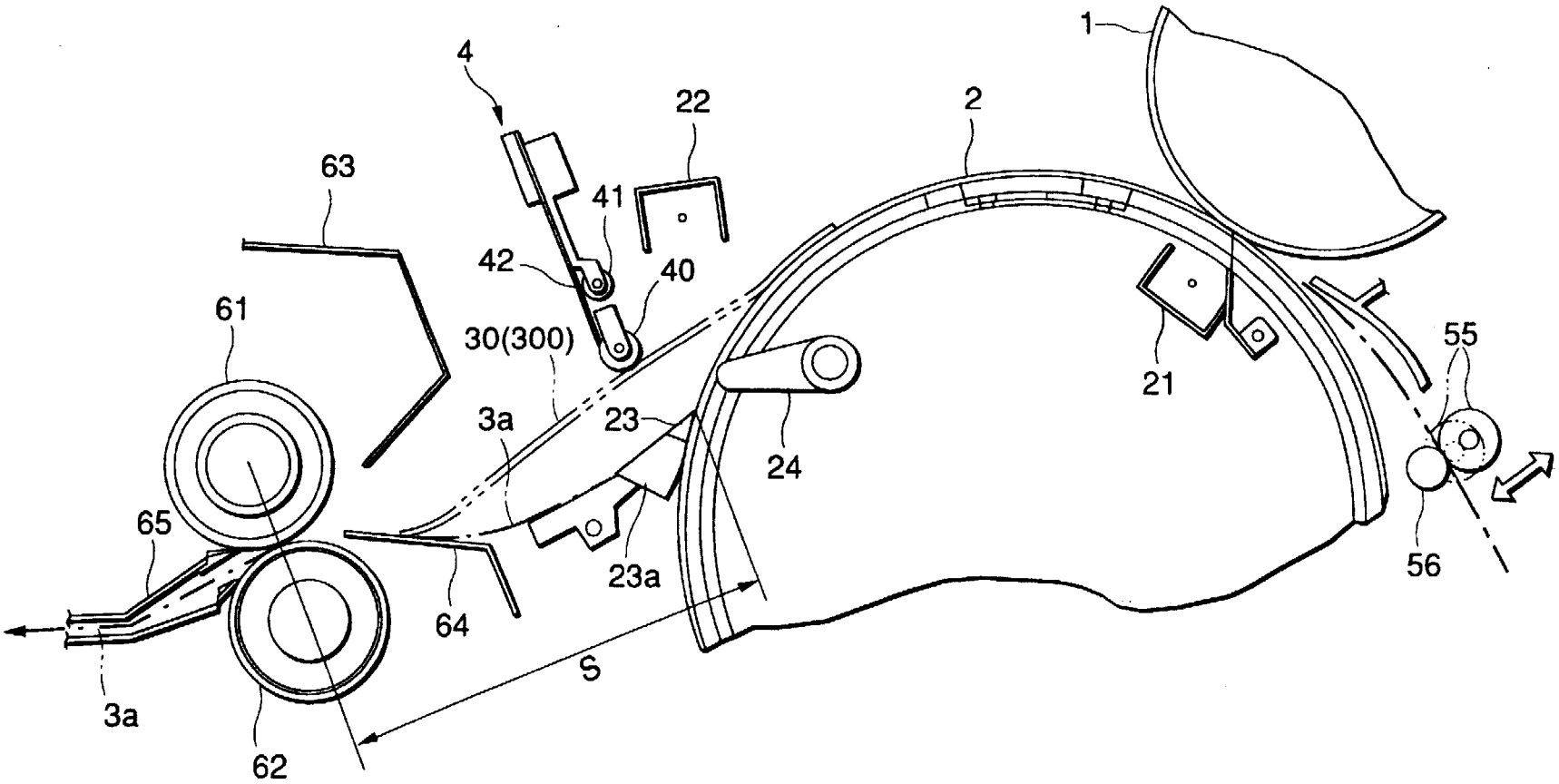
FIG. 2 is an enlarged view of the configuration relative to transportation of a thick sheet in the apparatus shown in FIG. 1.

FIGS. 1 and 2 show one embodiment of the image creating device according to the present invention. FIG. 1 is a conceptual view of the entire configuration of the image creating device. FIG. 2 is an enlarged view of the main part thereof. In FIGS. 1 and 2, reference numeral 1 denotes a photosensitive drum which is an image carrying body rotating in an arrow direction; 2 a transfer drum which is a sheet carrying/transporting rotating body rotating in an arrow direction; 3 a recording sheet; 30 a thick sheet (having a weighing capacity exceeding 104 g/m$^2$) of the recording sheet; 4 a thick sheet transporting assisting device (described later) which functions when the thick recording sheet 30 is detached from the transfer drum 2; 5 a sheet supply side transporting system; and 6 a fusing device. One-dot-chain line 3*a* indicates a transporting passage of the recording sheet, and particularly one-dot chain line 3*a* from the detachment position of the transfer drum 2 indicates the transportation passage after a normal sheet but not the thick sheet is detached.

In this image creating device, arranged around the photosensitive drum 1 are a charger 11 for uniformly charging the drum surface, a laser image exposure device 12 which serves as a latent image creating means for creating a latent image on the surface of the charged photosensitive drum 1, a rotary developing device 13, a pre-transfer charger 14, a pre-cleaning discharger 15 and a cleaning device 16 in this order. The rotary developing device 13 is provided with four developers 13K, 13Y, 13M and 13C containing black (K) toners, yellow (Y) toners, magenta (M) toners or cyan (C) toners. In development, these developers each containing prescribed toners corresponding to the color of the electrostatic latent image in development are rotated to positions in proximity with and opposite to the photosensitive drum 1 so that each of the developers is opposite to the photosensitive drum 1.

The transfer drum 2 has a structure in which a transfer film is wound around a ring-shaped drum frame. Arranged around the transfer drum 2 are an adsorption/transfer corotron 21 making charging for electrostatic adsorption of the recording sheet 3 on the transfer drum 2 and the electrostatic transfer of the toner image on the adsorbed recording sheet 3; a detachment discharger 22 for discharging the surface charges on the recording sheet 3 after the transfer step; a detachment piece 23 for mechanically detaching the recording sheet 3 with the surface charges discharged from the transfer drum (transfer film) 2; an internal pushing member 24 for pushing up the transfer film in engagement with the detachment operation of the detachment piece 23 from the inside of the drum; a pair of dischargers 25 for discharging the transfer drum after the recording sheet 3 is detached; and a cleaning roll 26 for removing paper powder applied to the transfer drum 2 in this order. Among these components, the detachment discharger 22 is arranged at such a position that the discharging area for discharging sufficiently reaches the sheet detaching position by the detaching piece 23 and the front and back peripheral portions thereof. The detachment piece 23 is provided with a detachment guide plate 23*a* for smoothly detaching the recording sheet in a width direction.

The sheet supply side transportation system 5 mainly includes a sheet transportation guide member 51 which is suitably arranged along a sheet transportation passage for supplying the recording sheet 3 to an adsorption/transfer position where the photosensitive drum 1 and the transfer drum 2 are opposite to each other in proximity; a register roll 52 for starting to transport the recording sheet 3 having a prescribed size to the adsorption/transfer position at predetermined timings; a preliminary register roll 53 having a non-prescribed to the adsorption/transfer position at the prescribed timings; and a roll-type curler device 54 serving as a curl imparting means for imparting a curl to the recording sheet 3 (mainly thick sheet 30) whose transportation has been started by the register roll 52 and the preliminary register roll 53 in a direction along the curvature of the carrying surface (transfer film surface) of the transfer drum 2.

The roll-type curler device 54 includes a pressurizing elastic roll 55 arranged so as to be shiftable and a rigid roll made of metal fixedly arranged. The elastic roll 55 rotates in a state where it is in pressure-contact with the rigid roll 56 and deformed, and hence a curl in a direction along the curvature of the peripheral surface of the transfer drum 2. In this device, particularly, the pressurizing elastic roll 55 is adapted to give a prescribed pressure to the thick recording sheet 30 in such a manner that it is shifted to two levels for one-side printing and both-side printing (second side). The level for the both-side (second side) printing of the pressurizing elastic roll 55 is also set for e.g. use of a postal card in an low humidity environment, or for printing of the second side of both-side printing of the recording sheet (normal sheet) other than the thick sheet.

The recording sheet 3 having a prescribed size which is placed in a sheet supply tray, when it is to be used, is transported to the register roll 52. On the other hand, the recording sheet 3 having a non-prescribed size which is set in a manual-setting tray (not shown), when it is used; is transported to the preliminary register roll 53. The thick sheet is supplied from the manual-setting tray.

The fusing device 6 mainly includes a heating roll 61 and a heating/pressurizing roll 62 which are fusing rolls rotating in contact with each other; a cover 63 for covering the fusing rolls; a post-detachment sheet transportation guide member 64 for guiding a nip portion of the fusing device while supporting the post-detachment sheet 3 from its lower side; and an ejecting side sheet transportation guide member 65 for ejecting th e recording s heet after fusing. In this fusing device 6, the distance S (see FIG. 2) between the nipping position of the heating roll 61 and the pressurizing roll 62 and the tip 23 of the detachment piece 23 is set to be shorter than the length of the smallest sheet in the sheet transporting direction.

The thick sheet transportation assisting device 3 arranged in the vicinity of the detachment/discharger 22 and detachment piece 23 in the image forming apparatus according to the present invention includes the following components.

Figure 3:
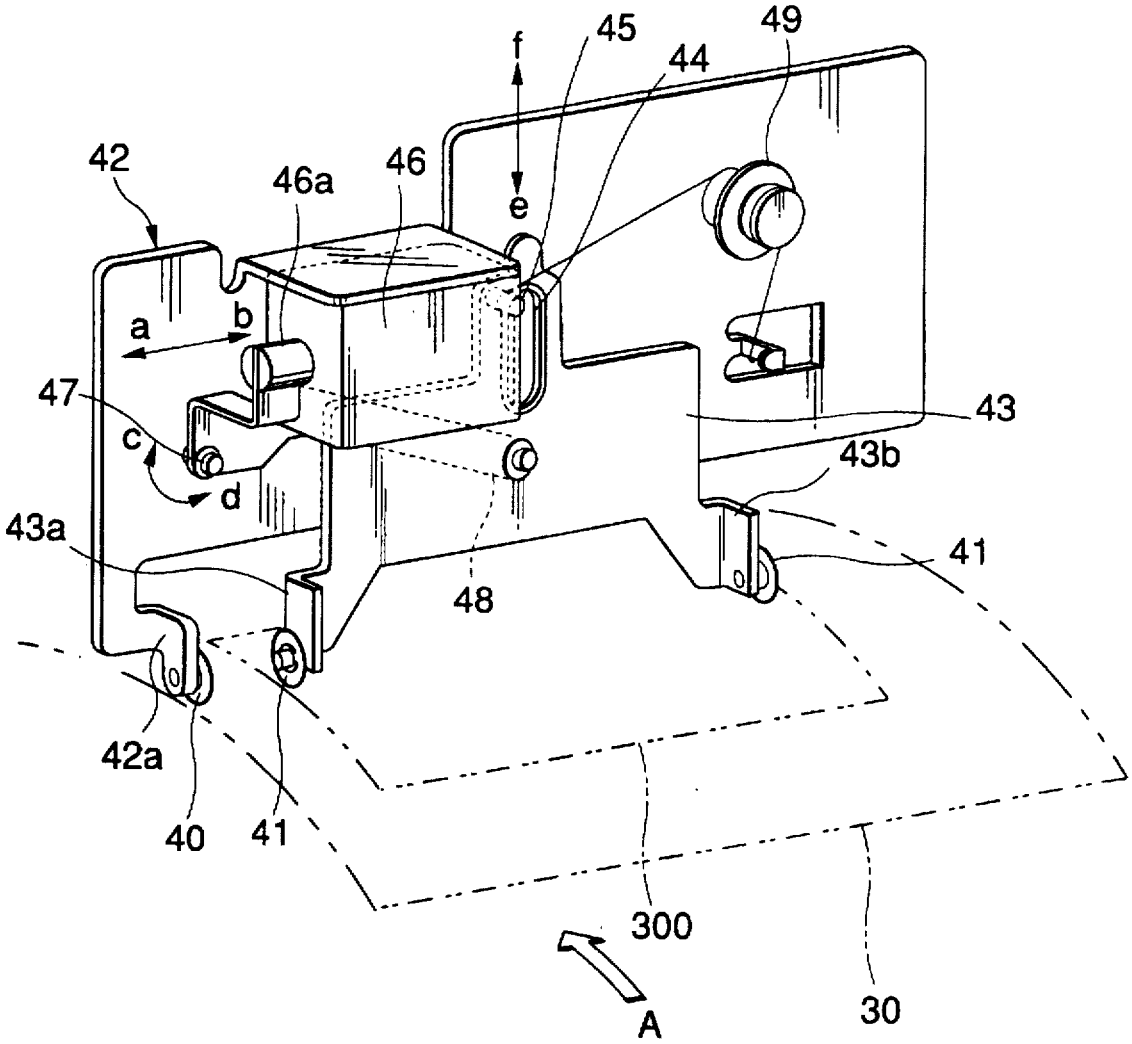
FIG. 3 is a perspective view showing a thick-sheet transportation assisting device.

As seen from FIGS. 2 and 3, the thick sheet transportation assisting device 4 includes a fixed thrusting member 40 and two shiftable thrusting members 41. The fixed thrusting member (rotary disk) 40 is rotatably attached to an attaching member 42*a* formed on the one side of a bracket 42 fixedly arranged. The shiftable thrusting members (rotary disks) 41 are rotatably attached to the attaching portions 43*a* and 43*b* formed at both lower sides of a plate 43 shiftably attached to the bracket 42.

The shiftable attachment structure of the plate 43 for the bracket 42 is so adapted that a long hole 44 for slide guide opened at the upper protruding piece of the plate 43 is fitted in a shaft 45 protruding at the substantial center of the bracket 42, and the entire plate 43 is rotatably supported at the other end of a movable arm member 48 whose one end is attached to the driving shaft 46*a* of solenoid 46 and which is axially supported by a supporting shaft 47 so as to rotate about it.

When the driving shaft 46*a* of solenoid 46 fixed at the bracket 42 shifts in a direction of arrows a, b, the movable arm member 48 rotates in a direction of arrows c, d about the supporting shaft 47. Therefore, the entire plate 43 attached to the one end of the movable arm member 48 shifts in a direction of arrows e, f for the bracket 42. Thus, the shiftable thrusting members 41 shift in a direction of arrows e, f as necessity requires.

The shiftable thrusting member 41 is shiftable in a direction of arrow e so that its lowest position is flush with the fixed thrusting member 40. Reference numeral 49 denotes a wire-pulling spring mechanism which urges the plate 43 in a direction of arrow f.

Figure 5:
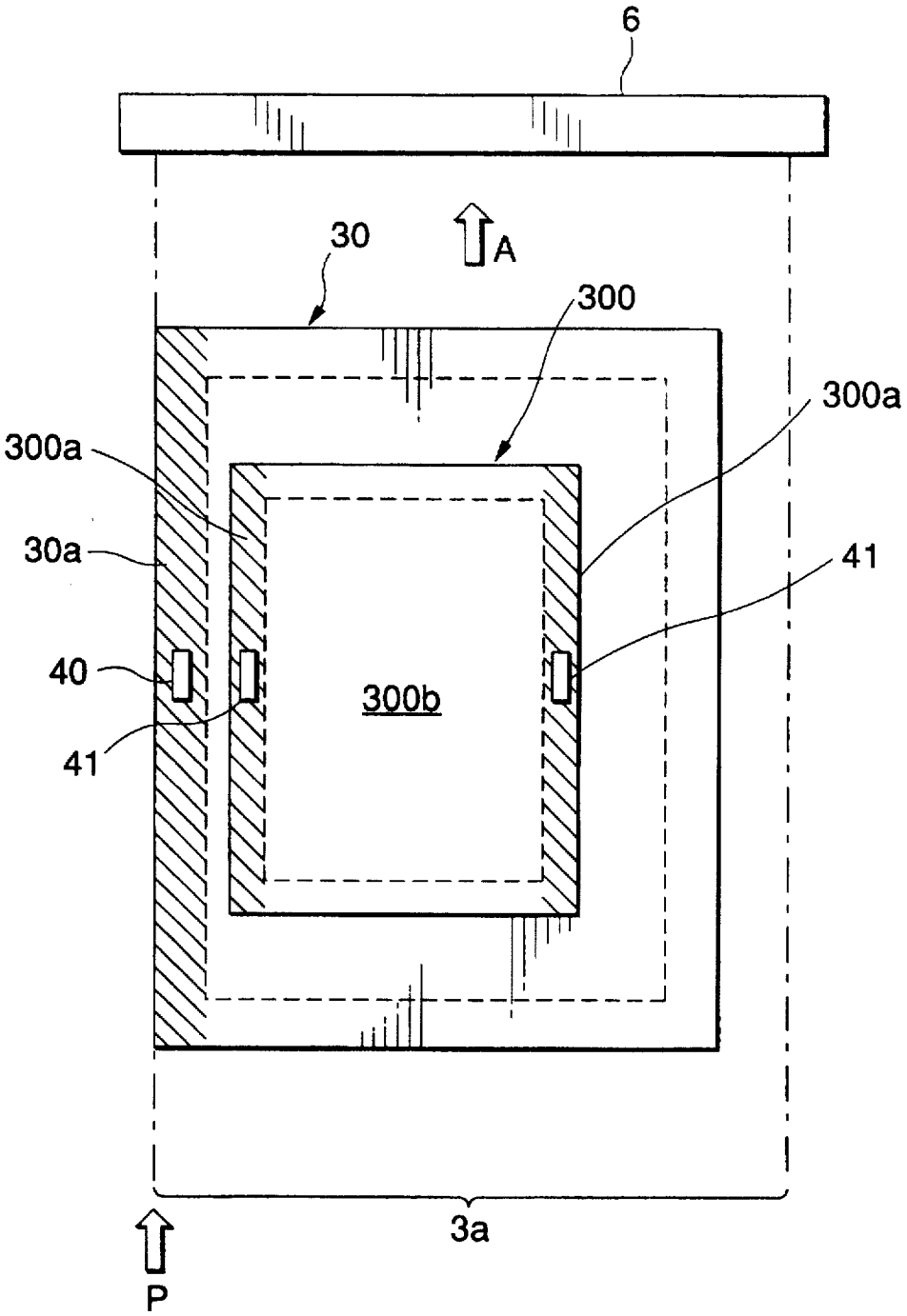
FIG. 5 is a plan view of the thrusting state of various thrusting members in the thick-sheet transportation device.

The fixed thrusting member 41 in the thick sheet transporting assisting device 4, as shown in FIG. 5, is located on a reference side P of the sheet transportation path 3*a* where the end of the sheet always passes during transfer, and at a position where the non-image area 30*a* (shaded portion) of the thick sheet 30 passing the reference side P is thrust. The fixed thrusting member 40 may be located one for each of the non-image areas on both left and right sides of the thick recording sheet 30. Where the single thrusting member 40 is provided to thrust the non-image area at the one side as in this embodiment, it is suitably set at such a position that the end of the sheet at the side opposite to the thrust position of the recording sheet 30 is not lifted by reaction and the entire sheet is not transported in an inclined state for the transportation direction. In FIG. 5, arrow A indicates a sheet transportation direction. FIG. 5 shows the state where the recording sheet 30 is transported to the fusing device 6 under thrust by the fixed thrusting member 40.

The shiftable thrusting members 41 in the thick sheet transportation assisting device 4, as seen from FIG. 5, lower to the same level flush with the fixed thrusting member 40 only when a thick recording sheet 300 (e.g. postal card) having a specific size of the thick recording sheet 30 is transported, and located at positions where the non-image areas 300*a* (shaded portion) of the specific thick recording sheet 300 is thrust. The thrusting action of the shiftable thrusting member 41 is performed in synchronism with the detachment action of the detachment piece 23.

Figure 4:
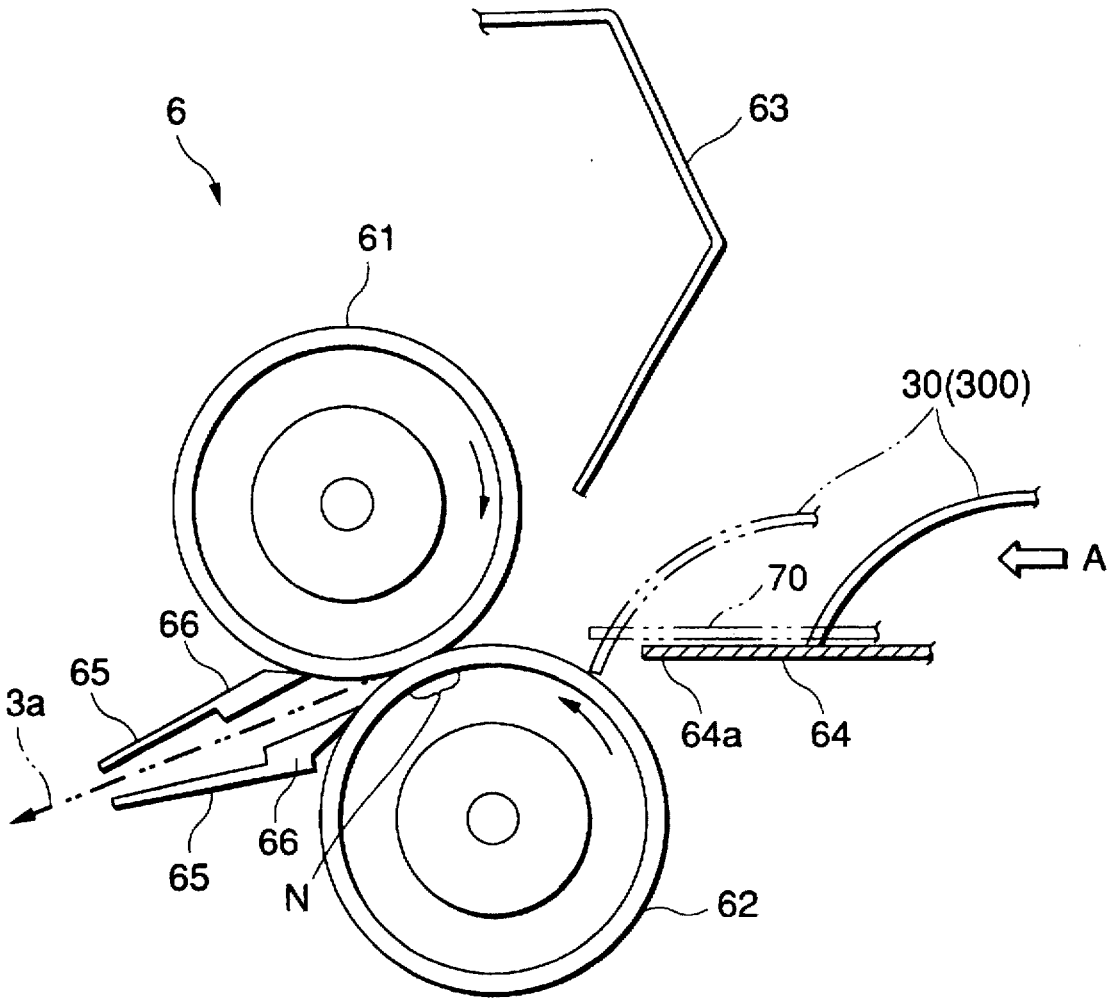
FIG. 4 is a schematic view of a fusing device and its peripheral part.

In addition, in the image forming apparatus according to the present invention, as seen from FIG. 4, the sheet transportation guide 64 for guiding the post-detachment thick recording sheet 30 (300) to the nip portion of the fusing device 6 is located at such a position that the tip of the sheet is initially brought into contact with the position in front of the nip portion N of the lower pressurizing roll 62. It is needless to say that the sheet transportation guide member 64 is so located that after the tip of the sheet is brought into contact with the position in front of the nip position N of the pressuring roll 62, while it is guided to the nip portion N of by the rotational force of the pressurizing roll 62, the upper side of the tip of the sheet is not in contact with the cover 63. Reference numeral 66 denotes a detachment piece arranged on the outgoing side of the nip portion N.

In FIG. 4, the setting state of a conventional sheet transportation guide member 70 is shown for reference. Namely, the conventional sheet transportation guide member 70 is arranged in its entirety in a horizontal state and its tip is in the vicinity of the nip portion. On the other hand, the sheet transportation guide member 64 in this embodiment is so located that its tip 64*a* is farther from the nip portion than in the conventional guide member 70, and the tip side is slightly front-down from the horizontal state (left down in the figure).

An explanation will be given of the image forming apparatus having the structure described above.

First, an explanation will be given of the basic operation of image creation. For example, where a full-color image is to be created on various kinds of recording sheets 3 (30, 300), after the photosensitive drum 1 is charged by a charger 11, image exposure by a laser image exposure device 12 is effected for the charged surface, thus creating a first electrostatic latent image. The electrostatic latent image is developed by a developer 13 containing toners with the corresponding color to provide a toner image. The first-color toner image is charged by a pre-transfer charger 14, and thereafter is shifted to a transfer position.

On the other hand, after the recording sheet 3 is supplied to the register roll 52 or preliminary register roll 53 from a tray for a prescribed size or another tray for manual sheet setting, it is sent out toward the closely opposite position (adsorption/transfer position) of the photosensitive drum 1 and the transfer drum 2 at a predetermined timing via the curler device by driving the register roll 52 (or preliminary register roll 53). When the tip of the recording sheet 3 reaches and passes the adsorption/transfer position and the toner image also reaches the adsorption position, the adsorption/transfer corotron 21 starts to operate. Thus, the recording sheet 3 is electrostatically adsorbed on the transfer drum 2 and the first-color toner image is electrostatically transported onto the recording sheet 3.

The toner image creation step and its transfer step as that for the first color are repeated for the second, third and fourth colors. Thus, the toner images of the second, third and fourth colors are created successively on the photosensitive drum 1, and adsorbed onto the transfer drum 2. As a result, they are successively transferred superposedly on the recording sheet 3 on which the first color toner image has been transferred.

Upon completion of transfer of the final color (fourth-color) toner image, after the recording sheet 3 is discharged by the detachment discharger, it is detached from the surface of the transfer drum surface by deformation of a transfer film of the transfer drum 2 by an internal pushing member 24 and mechanical detachment. The detached recording sheet 3 is sent to the fusing device 6 through the sheet guide member 64 and others and passes the nip portion of the heating roll 61 and the heating/pressurizing roll 62 so that the transferred non-fixed toner image is fixed. On the other hand, the transfer drum 2 after the recording sheet is detached is discharged by a pair of dischargers 25, and dust like paper powder applied on the drum is removed by the cleaning device 2.

The image forming apparatus according to the present invention, where a thick recording sheet 30 (300) is used as the recording sheet, carries out the following transportation of the thick sheet. An explanation will be given of the transportation of the thick sheet.

First, the thick recording sheet 30 (300) is supplied with a predetermined curl by the curler device 54 and transported to the transfer drum 2. The thick sheet is electrostatically adsorbed to the transfer drum 2, and the toner image on the photosensitive drum 1 is transferred to the sheet by the number of times.

Figure 6A:
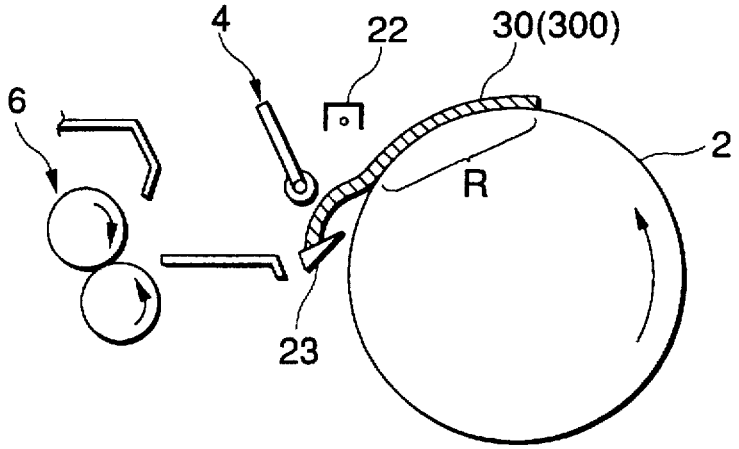
FIGS. 6A–6C is a conceptual view for explaining the manner of a thick-sheet transporting method at the time of detachment and after the detachment.
Figure 6B:
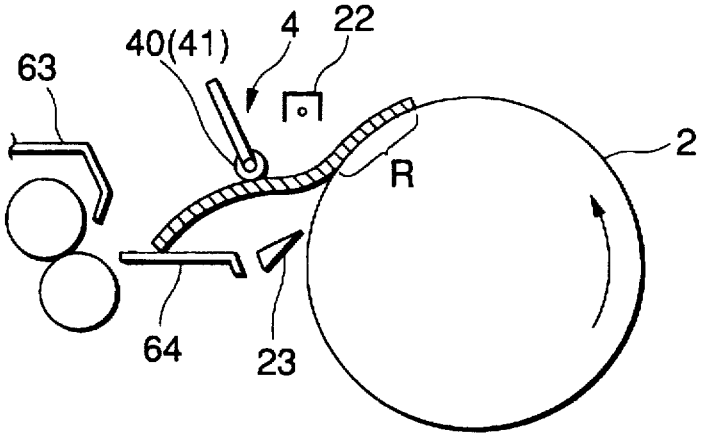

Upon completion of transfer, the thick recording sheet 30 (300), as seen from FIG. 6*a*, is detached from the transfer drum 2 under the detachment action by the detachment discharger 22 and the detachment piece 23. Then, since the recording sheet 30 (300) has an adsorption area R where the portion not detached is adsorbed to the transfer drum 2, it is urged in a sheet transportation direction by the rotational force of the transfer drum 2 and hence transported toward the fusing device 6. The recording sheet 30 (300), which is given the curl, has an upward curved state (posture) when it is detached from the transfer drum 2. Thus, a sheet portion before reaching the detachment piece starts to exfoliate from the transfer drum 2. As a result, the thick recording sheet is transported while being detached in a further upward curved state. The thick recording sheet 30 (300) detached and transported in such a curved state, as shown in FIG. 6*b*, when it passes immediately below the thick sheet transportation assisting device 4, the non-image area which is to pass the position higher than that of the thrusting member 40 (41) of the device 4 is thrust by the thrusting member 40 (41). Specifically, the thick recording sheet 30 transported along the reference terminal P of the sheet transportation path is thrust by the fixed thrusting member, and the specific thick sheet 300 is thrust by the shiftable thrusting members 41 which are shiftable only when the use mode of the sheet 300 is set (see FIGS. 3 and 5).

Because of thrusting by the thrusting member 40 (41), the thick recording sheet 30 (300) undergoes the pressing force in a direction reverse to that of curl imparting direction. Thus, the recording sheet is suppressed from passing at the position higher than the thrusting member 40 (41). Simultaneously, the three-point supporting state of the sheet by the thrusting member 40 (41), the sheet transportation guide member 64 and the transfer drum 2 suppress the detaching sheet portion from being detached from the transfer drum 2, thus assuring the adsorption state (adsorption area R). As a result, the thick recording sheet is prevented from being brought into contact with the detachment discharger 22 in detachment while the transportation force by the rotational force of the transfer drum 2.

Figure 6C:
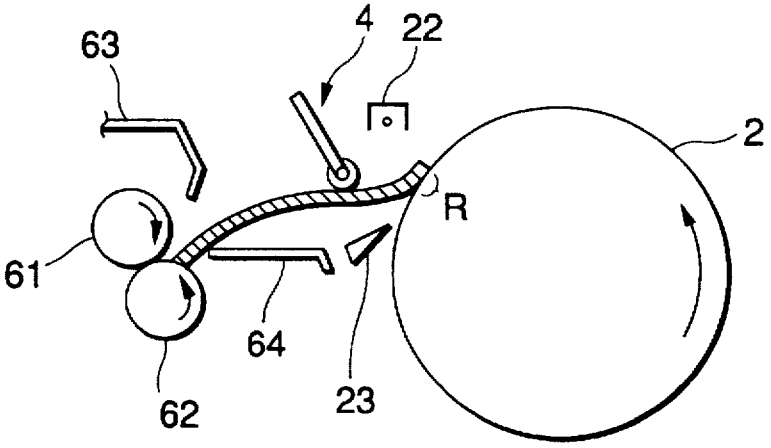
Figure 7:
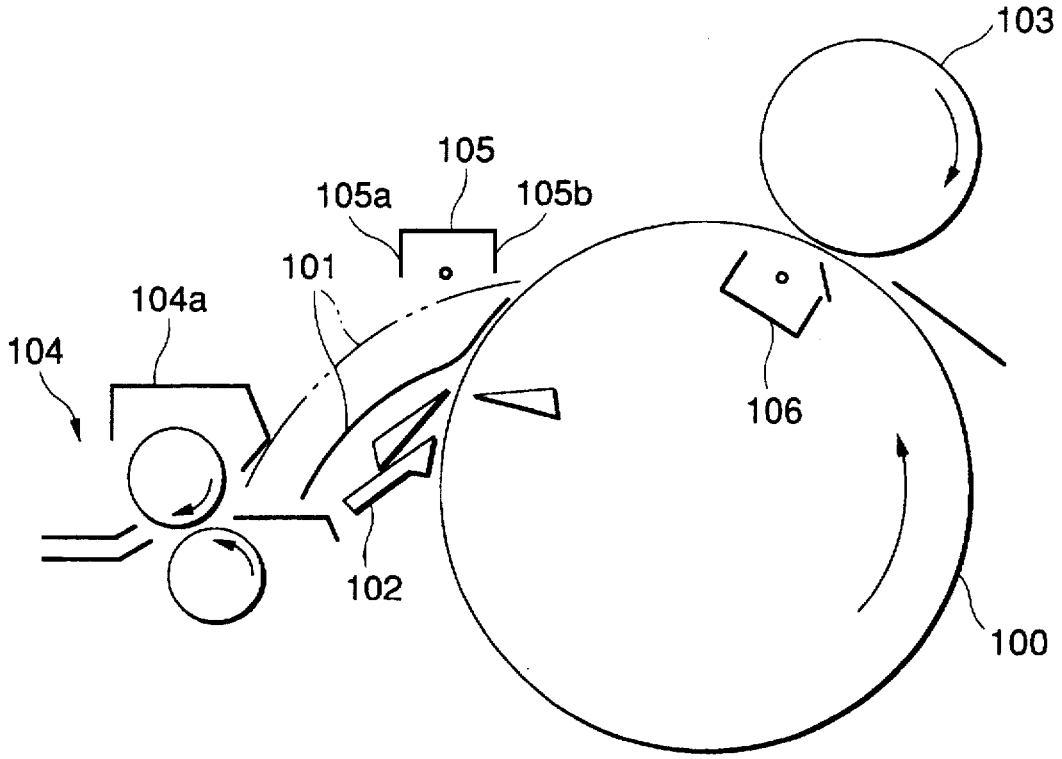
FIG. 7 is a conceptual view for explaining transportation failure and image smudge phenomena occurred in the prior art.
Figure 8:
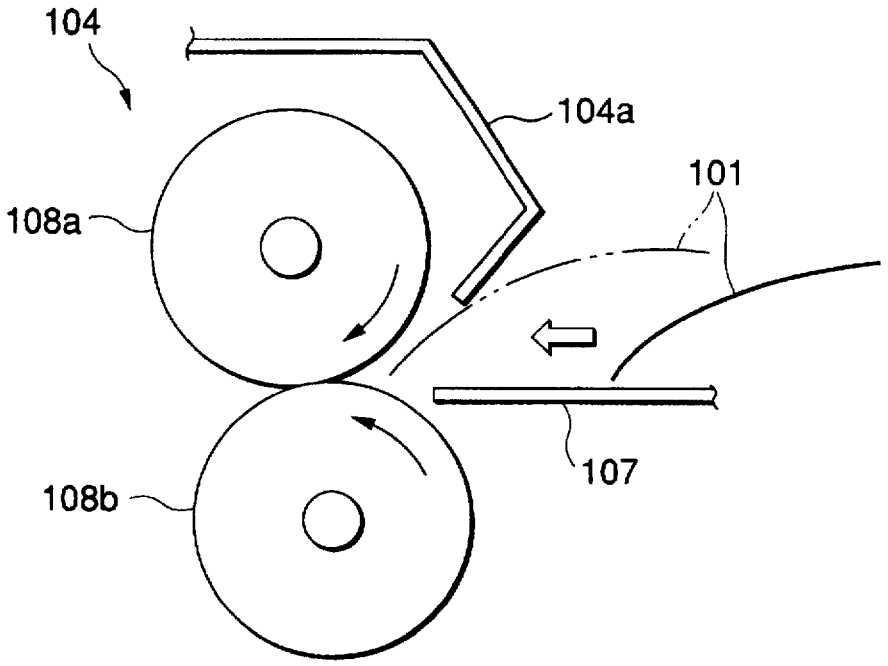
FIG. 8 is a conceptual view for explaining image smudge phenomena occurred in the vicinity of a fusing device in the prior art.

Finally, the thick recording sheet 30 (300) being detached and transported while being thrust by the thrusting member 40 (41), as shown in FIG. 6*c*, when it passes the terminal end of the sheet guide member 64, the sheet tip falls downward and is brought into contact with the heating/pressurizing roll 62 of the fusing device 6. Thereafter, by the above transportation force in detachment and the rotational force of the pressurizing roll 62, the thick sheet is guided to the heating roll 61 and the heating/pressurizing roll 62 (see FIG. 4). Then, the sheet tip is maintained in a state separated from the cover 63 of the fusing device 6, and the rear sheet portion is separated from the cover 63 and not in contact with the cover 63 under thrust by the thrusting member 40 (41).

The thick recording sheet 30 (300) adsorbed to the transfer drum 2 after it is given a curl can be smoothly transported under thrust by the thrusting member of the thick sheet transportation device 4 and by transportation guiding by the sheet guide. In addition, the thick sheet is not rubbed because of its contact with the detachment/discharging device 22 and the fusing device 6 (cover or roll) so that it can be detached from the transfer drum 2 in a stabilized state and transported to the fusing device.

As described above, in accordance with the present invention, the thick recording sheet adsorbed to the sheet carrying/transporting rotational body after it is given a curl can be smoothly transported under thrust by the thrusting member arranged at a specific position and by transportation guiding by the sheet guide between the detachment piece and the fusing device.

In addition, the thick sheet is not brought into contact with the detachment/discharging device and the fusing device (cover or roll) so that it can be detached from the sheet carrying transportation rotating body and transported to the fusing device.

As a result, good transportation of the thick sheet free from poor transportation and image smudging phenomenon and hence improved image creation on the thick sheet can be realized.

Where the thick recording sheet having a smaller size of thick recording sheets having different sizes in a direction perpendicular to the sheet transportation direction is thrust by the shiftable thrusting member which is shiftable only when the thick sheet at issue is to be transported, when the recording sheet having a larger size than the above specific size is transported, it is possible to surely prevent the image smudge phenomenon due to the thrusting member for the small size sheet from being induced on the image area on the recording sheet of the larger size.

In addition, in this case, if the thrusting by the shiftable thrusting member is engaged with the detachment action of the detachment means, the transportation failure and image smudging phenomenon can be surely prevented. For example, where the above thrusting is carried out later than the detachment action, it becomes gradually difficult to adsorb the recording sheet on the sheet carrying/transporting rotational body so that the transportation failure is likely to occur.

Where the thick recording sheet detached and transported along the reference terminal of the sheet transportation path is thrust by the thrusting member fixedly on the reference side, the transportation failure and image smudge phenomenon can be effectively prevented by a more simple structure.

What is claimed is:

1. An image forming apparatus comprising:

an image carrying body on which a toner image is created;

a sheet carrying/transporting rotational body for adsorbing a recording sheet to which the toner image on the image carrying body is transferred and for transporting the sheet;

a detaching means for detaching the recording sheet after transfer from the sheet carrying/transporting rotational body;

a recording sheet transporting assisting device that thrusts the non-image area of the recording sheet toward the sheet carrying/transporting rotational body; and a curl imparting means for imparting to a thick recording sheet a curl in a direction along the carrying curve of the rotational body before the thick recording sheet is adsorbed to said sheet carrying/transporting rotational body, wherein said recording sheet transportation assisting device thrusts the recording sheet in a direction opposite to said curl imparting direction.

2. An image forming apparatus comprising:

an image carrying body on which a toner image is created;

a sheet carrying/transporting rotational body for adsorbing a recording sheet to which the toner image on the image carrying body is transferred and for transporting the sheet;

a detaching means for detaching the recording sheet after transfer from the sheet carrying/transporting rotational body; and a recording sheet transporting assisting device that thrusts the non-image area of the recording sheet to suppress detachment of the recording sheet from the sheet carrying/transporting rotational body, wherein said recording sheet transportation assisting device comprises a plurality of thrusting members that thrust recording sheets having different sizes in a direction perpendicular to a sheet transporting direction in accordance with their different sizes, and said thrusting member of said plurality of thrusting members which thrust the recording sheet having a smaller size is provided shiftably in the direction of thrusting.

3. An image forming apparatus according to claim 2, wherein said shifting is carried out in engagement with a detachment operation of the said detachment means.

4. An image forming apparatus according to claim 2, wherein at least one of fixed thrusting members other than the shiftably thrusting members in the recording sheet transportation assisting device is located on a reference terminal side of a sheet transportation path.

5. An image forming apparatus comprising:

an image carrying body on which a toner image is created;

a sheet carrying/transporting rotational body for adsorbing a recording sheet to which the toner image on the image carrying body is transferred and for transporting the sheet;

a detaching means for detaching the recording sheet after transfer from the sheet carrying/transporting rotational body;

a recording sheet transporting assisting device that thrusts the non-image area of the recording sheet toward the sheet carrying/transporting rotational body; and a fusing means including a pair of fusing rolls rotating in contact with each other and a sheet transporting guide member for guiding the recording sheet after detachment while supporting it from the lower side thereof, wherein said sheet transportation guide member is arranged so that the tip of said recording sheet is initially brought into contact with the lower fusing roll in front of a nip portion of said fusing rolls.

6. An image forming apparatus comprising:

an image carrying body on which a toner image is created;

a sheet carrying/transporting rotational body for adsorbing a recording sheet to which the toner image on the image carrying body is transferred and for transporting the sheet in a sheet transporting direction;

a detaching means for detaching the recording sheet after transfer from the sheet carrying/transporting rotational body; and a recording sheet transporting assisting device that thrusts the non-image area of the recording sheet toward the sheet carrying/transporting rotational body, wherein the distance between said detachment means and a fusing portion of a fusing means is shorter than the length of a recording sheet having a smallest size in the sheet transporting direction.

* * * * *